United States Patent [19]

Hiatt

[11] Patent Number: 4,555,097

[45] Date of Patent: Nov. 26, 1985

[54] COMBINATION ROUND COIL SPRING AND RECTANGULAR TORSION COIL SPRING ASSEMBLY

[75] Inventor: Sidney A. Hiatt, Carthage, Mo.

[73] Assignee: Leggett & Platt, Incorporated, Carthage, Mo.

[21] Appl. No.: 494,713

[22] Filed: May 16, 1983

[51] Int. Cl.[4] ..... A47C 23/02; F16F 1/08

[52] U.S. Cl. ..... 267/100; 5/247; 5/248; 5/256; 267/166

[58] Field of Search ..... 267/91, 93, 100, 101, 267/103, 112, 166, 167, 178, 179; 5/247, 248, 254, 255, 256, 257, 275, 272, 273, 274, 276, 475, 267

[56] References Cited

U.S. PATENT DOCUMENTS

| | | | |
|---|---|---|---|
| 1,631,056 | 5/1927 | Pepernick | 5/256 |
| 1,887,058 | 11/1932 | Karr | 5/256 |
| 1,964,950 | 7/1934 | Karr | 5/275 |
| 2,773,270 | 12/1956 | Rozelle | 5/475 |
| 3,082,438 | 3/1963 | Nachman, Jr. | 5/248 |
| 3,533,114 | 10/1970 | Karpen | 5/475 |
| 3,916,463 | 11/1975 | Higgins | 267/93 |
| 4,012,801 | 3/1977 | King et al. | 5/247 |
| 4,012,802 | 3/1977 | Hutchinson et al. | 5/247 |
| 4,101,993 | 7/1978 | Yates et al. | 5/267 |
| 4,160,544 | 7/1979 | Higgins | 267/100 |

*Primary Examiner*—Bruce H. Stoner, Jr.
*Assistant Examiner*—Robert J. Oberleitner
*Attorney, Agent, or Firm*—Wood, Herron & Evans

[57] ABSTRACT

A core spring assembly combines the use of rows and/or columns of round coil springs with rows and/or columns of rectangular torsion bar coil springs, all interconnected in a top plane by a welded wire grid so as to create a spring core assembly for a bedding mattress or box spring. In one preferred form, the rectangular torsion bar coil springs are located about the periphery of the spring assembly while in another embodiment the rectangular torsion bar coil springs are all located in the center one-third of the spring assembly so as to increase the firmness of that center section of the unit.

9 Claims, 8 Drawing Figures

18
24
22
30
25
20
46
50
21
47
58
60
48
26
27
16
14
40
64
62
12
66

COMBINATION ROUND COIL SPRING AND RECTANGULAR TORSION COIL SPRING ASSEMBLY

This invention relates to spring assemblies. More particularly, this invention relates to an improved spring assembly of the type used in the bedding industry in which rows and columns of coil springs are interconnected in the top and bottom planes and are covered on either the top or the top and bottom with a cushion or pad of material, e.g., woven on nonwoven batting or foam rubber or the like enclosed within an upholstered fabric or cloth sheet or the like to form a finished mattress or box spring.

In the bedding industry, i.e., in the mattress and box spring industry, customer demand and preference in recent years has been for greater firmness in both the mattresses and supporting box springs. There are a couple of different basic approaches which have been used to increase the firmness of a mattress or box spring. One approach is to simply increase the number of springs within the unit. Another approach has been to increase the gauge from which the springs within the bedding are fabricated. Both of these approaches result in increased fabrication costs; in the first instance because of the increased number of coils required in the spring unit, and in the second instance because of the increased wire gauge for each of the coils and spring unit.

Still another approach which has been used in connection with box springs only has been that of utilizing rectangular torsion bar coil springs in place of more conventional round coil springs. The rectangular torsion bar type spring has a topmost coil which is generally rectangular but may be of any configuration. From this top coil or head, the body of the coil is formed by a succession of straight lengths of wire bent at right angles to each other to form a generally rectangular pattern or torsion bars in which at least some of the lengths from top to bottom are angled downwardly. One example of such a box spring made from a plurality of rectangular torsion bar coil springs may be found in U.S. Pat. No. 4,101,993. Other patents which disclose box springs manufactured from rectangular torsion bar coil springs are U.S. Pat. No. 4,120,058, U.S. Pat. No. 3,755,833 and U.S. Pat. No. 3,286,281. However, the use of torsion bar type coil springs in a mattress or box spring coil assembly, while it results in increased firmness at relatively low fabrication costs, has generally been found to be unsatisfactory because the coil springs lack the resiliency and desired "feel" of a round coil spring unit. Furthermore, the torsion bar type rectangular coil springs lack the optimal load deflection characteristics of a bedding type spring product wherein the load required to effect a given increment of deflection remains substantially constant throughout most of the deflection of the spring unit. In the case of the torsion bar type coil spring unit, the load increases markedly for a given increment of deflection as the deflection increases. The torsion bar type coil springs are also subject to fatigue failure much more quickly than are the more common circular type of coil springs.

One advantage which the rectangular torsion bar type coil springs have over the circular coil springs is that of increased resistance to lateral or sideways deflection of the spring unit. In other words, the torsion bar type coil springs have substantially greater resistance to lateral deflection than do circular coil springs with the result that spring units made from torsion bar coil springs transmit much less lateral deflection from one part of the spring unit to the other than do spray units made from round coil springs. The advantage of this characteristic is that it isolates one part of the bed from deflection of another part so that if two people are sleeping on a single bedding spring product, movement of one person on the top surface of the spring product is not transmitted or felt by the other person. As a result, each person in the bed is less subject to having his or her sleep disturbed by movement of the other.

It has been a primary objective of this invention to provide a spring assembly which has the conventional resiliency and comfort characteristics of a round coil bedding spring product but which also has the resistance to lateral deflection characteristic of a torsion bar coil spring bedding product.

Still another objective of this invention has been to provide a spring assembly which has the durability and long useful life characteristic of a coil spring bedding product, but which also has the resistance to lateral deflection characteristic of a torsion bar coil spring bedding product.

To achieve these objectives the invention of this application comprises a bedding spring product wherein most of the rows and columns of the unit are manufactured from round coil springs, but wherein selected rows and columns are manufactured from torsion bar spring products. In one preferred embodiment the torsion bar coil springs are located about the periphery of the spring unit while in another embodiment the torsion bar coil springs are located in the center one-third of the spring unit. In both embodiments though the top turns or heads of all of the coil springs are interconnected by a welded wire grid which has reversely bent U-shaped hooks formed in the wires of the grid for receiving and securing the heads of both the round coils and the rectangular coils in a common top plane of the spring assembly.

The primary advantage of this invention is that it achieves the best deflection and resilience characteristics of a round coil spring bedding product with the resistance to lateral deflection characteristics of a torsion bar coil spring product.

In the case of the embodiment wherein rectangular torsion bar coils are located about the periphery of the spring unit, the resulting spring product has the advantage of being quieter than spring products utilizing round coils at this point of the spring assembly. The quietness of the resulting product results from one side or a portion of one side of the generally rectangular head of the torsion bar coils being located beneath and secured to the border wire of the spring unit. Round coils generally have a circular head or topmost turn which is secured to the side of the border wire with the result that the top turn may move relative to the border wire to which it is clipped and may present a noise problem. This embodiment also has the advantage of being firmer at the edge than is the center of the unit with the result that a person may sit or sleep nearer the edge of the spring unit without having the edge collapse with the person.

These and other objects and advantages of this invention will be more readily apparent from the following description of the drawings in which.

Figure 1:
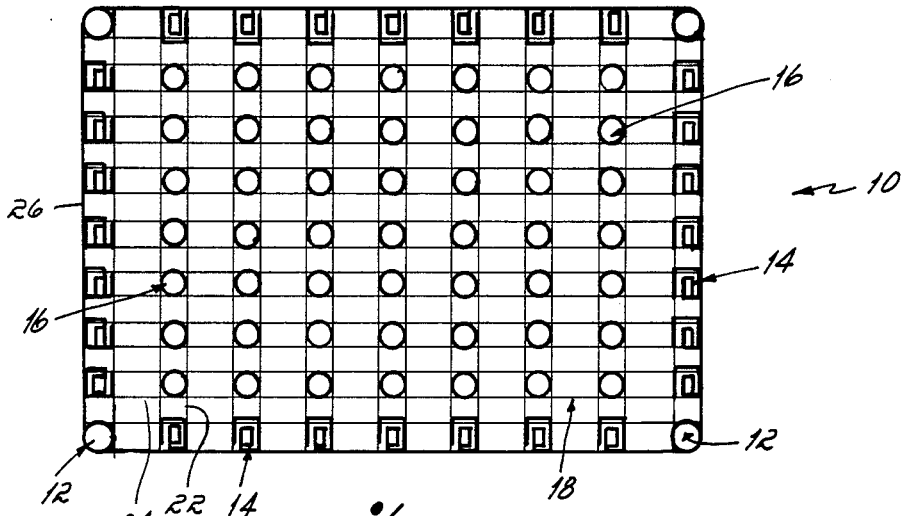
FIG. 1 is a top plan view of a box spring incorporating the invention of this application.
Figure 2:
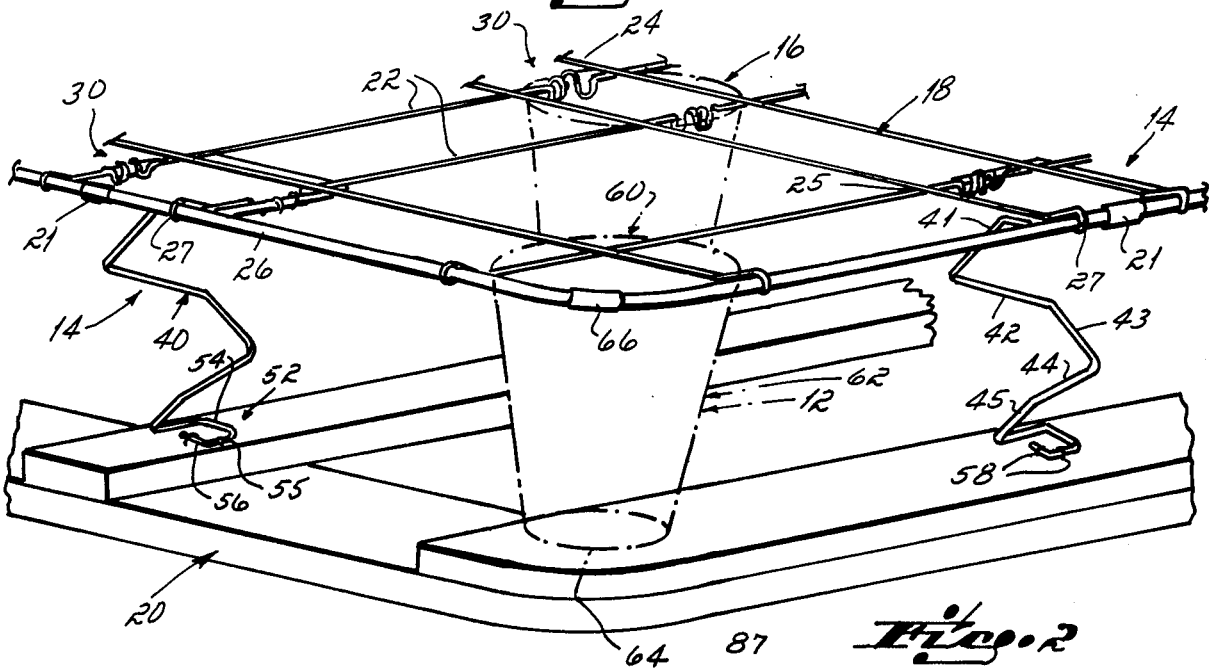
FIG. 2 is a perspective view of one corner of the box spring of FIG. 1.
Figure 3:
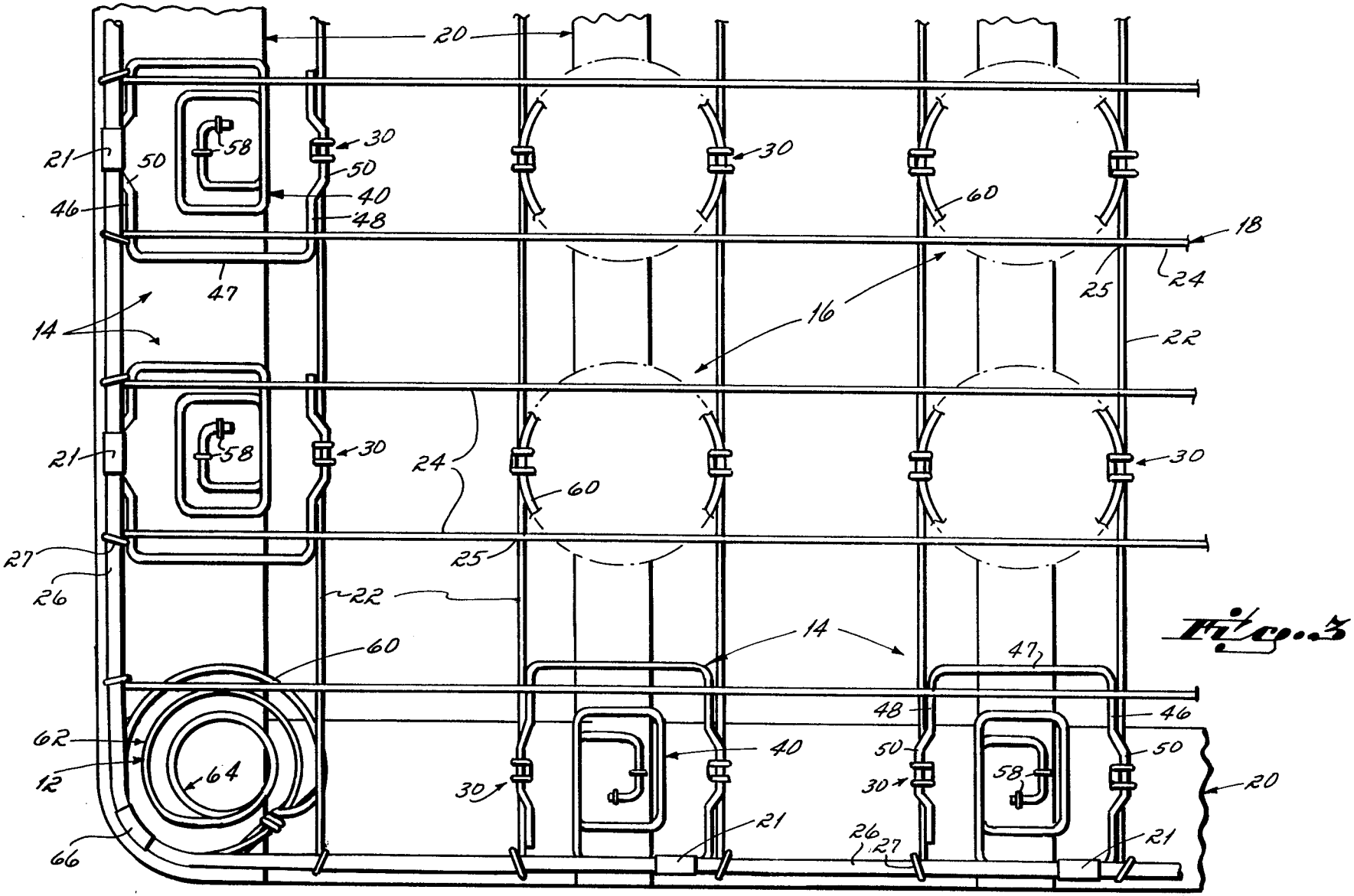
FIG. 3 is a top plan view of another corner of the box spring of FIG. 1.
Figure 4:
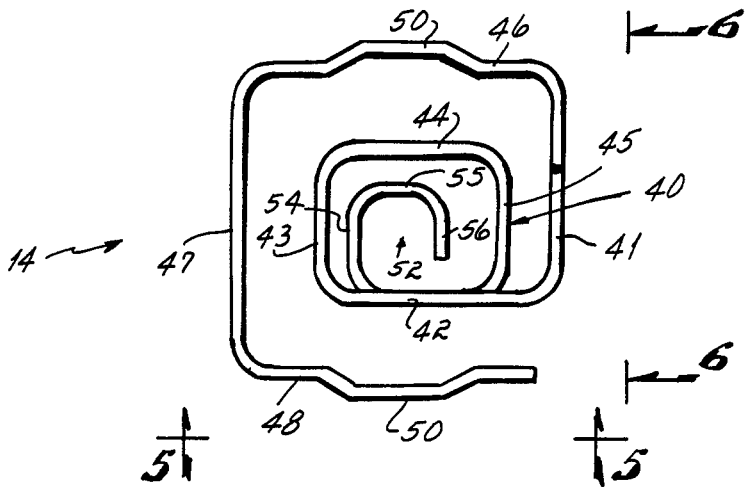
FIG. 4 is a top plan view of one of the rectangular torsion bar coils employed in the box spring of FIG. 1.
Figure 5:
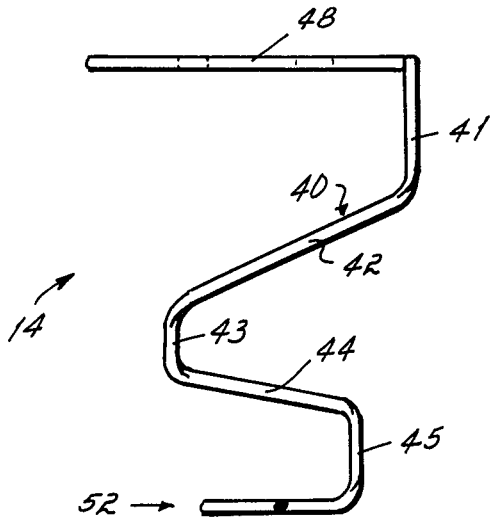
FIG. 5 is a side elevational view taken on line 5—5 of FIG. 4.
Figure 6:
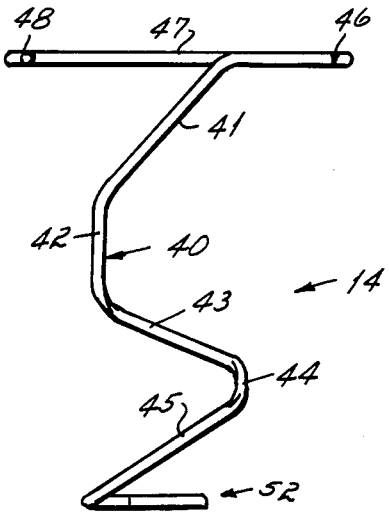
FIG. 6 is a side elevational view taken on line 6—6 of FIG. 4.

With reference first to FIGS. 1–3, there is illustrated a box spring assembly 10 wherein the coils of the spring are arranged in longitudinal columns and transverse rows. The coil springs at each end of each column and each transverse row except for the corner-most coils 12 are all rectangular torsion bar coils 14. The corner coils as well as all other interior coils 16 of the spring assembly 10 are conventional round coils 16. All of the coils are connected in a top plane of the spring unit to a welded wire grid 18 and are connected at the bottom to a wooden frame 20.

The welded wire grid 18 comprises a first series of spaced transversely extending parallel wires 22 and a second series of longitudinally extending parallel wires 24. These two series of wires extend at right angles to one another and are welded at their intersections 25. The ends 27 of both series of wires extend to and wrap around a rectangular border wire 26. Preferably, these ends 27 of the wrap are welded to the rectangular border wire.

Figure 7:
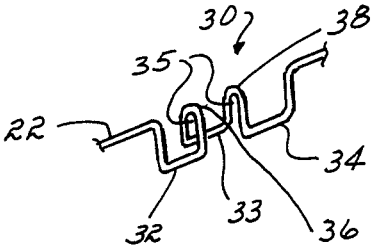
FIG. 7 is a diagrammatic view of the reverse bend loop of a grid wire.

The transversely extending grid wires 22 have a series of return bends 30 formed therein as shown in FIG. 7. Each return bend consists of first and third bights 32, 34 which lie in a common plane, transverse bends 36, 38 which project laterally from the common plane, and a central bight 33 which initially extends in a plane substantially parallel to the common plane of the first and third bights 32, 34. This configuration provides a channel 35 between the second bight 33 and the endmost bights 32, 34. Prior to assembly of the coil springs to the welded wire grid, this channel is open downwardly. When the topmost turns or heads of the coils 14 and/or 16 are placed in the channels as illustrated in FIGS. 2 and 3, the centermost bight 33 is bent around the top turn of the coils so as to entrap that top coil in the channel 35, thereby fixedly securing the top turns of the coils 12, 14 and 16 to the welded wire grid.

Each of the coil springs, whether of the circular or rectangular configuration, is formed of a single continuous length of spring wire having a vertically extensive spring body and a top loop or head. In the case of the rectangular coils 14, the spring body 40 comprises a single generally coil shaped vertically extending series of straight lengths of wire 41, 42, 43, 44 and 45 bent at right angles to each other to form a succession of rectangular patterns in which all of the straight lengths of wire 41–45 from top to bottom are successively angled downwardly so as to operate in torsion and produce a continuous rectangular torsion bar coil spring. The topmost one of these straight bar sections is connected via a right angle bend to the top loop of the coil which is formed by three successive straight bar sections 46, 47, 48 located in a common horizontal plane and interconnected by right angle bends. The straight bar sections 46 and 48 of the topmost loop are offset as indicated at 50 and are connected by the reverse bends 30 to the welded wire grid 18 and by clips 21 to the border wire 26. The provision of the offsets on the top loop prevents the topmost loops from moving laterally relative to the wire grid of the border wire 26 when an uneven load is placed upon the coils.

The bottommost one of the straight bar section 45 terminates in a generally rectangular bottom loop 52 which is also generally rectangular in configuration. This loop is also located in a horizontal plane. It is formed by three successive straight lengths of wire 54, 55 and 56 interconnected by right angle bends. As may be seen most clearly in FIGS. 2 and 3, the bottom loop of each rectangular coil is fixedly connected to the wooden rectangular frame 20 as by staples 58.

The round coils 16 each comprise a round top loop 60, a spring body 62, and a bottom loop 64, all formed from a single continuous length of spring wire. As may be seen most clearly in FIGS. 2 and 3, the spring body is generally helical in configuration and terminates at its upper end in the top loop 60 and at its lower end in the bottom loop 64. The top loops of all but the corner coils 12 are connected by a pair of reverse bends 30 to the welded wire grid 18. The top loop of the corner coils 12 are connected by a metal clip 66 to the border wire 26. The bottom loop of all of the round coils is secured as by staples (not shown) to the top of the wooden frame 20.

In the illustrated embodiment, the helical spring body of all of the round coils 12, 16 is illustrated as being of a single cone configuration, but it could as well be of a double cone or hourglass configuration or a straight cylindrical configuration.

With reference to FIGS. 2 and 3 it will be seen that each corner curvature of the top loop of the round coils approximately matches the radius of the corner of the border wire so that the top loop of the corner coils does not extend beyond or at least does not appreciably extend beyond the corner of the border wire.

The spring assembly illustrated in FIGS. 1–7 has numerous advantages over either all round coil spring assemblies or all rectangular torsion bar spring assemblies. Specifically, this spring assembly 10 has the resiliency and feel advantages and sleeping comfort of an all round compression coil assembly together with the edge firmness and resistance to lateral deflection characteristic of an all torsion bar coil spring assembly. Additionally, this spring assembly 10 is less expensive than a comparable all round coil spring assembly because the rectangular torsion bar coil springs generally incorporate less wire than round coil springs.

Figure 8:
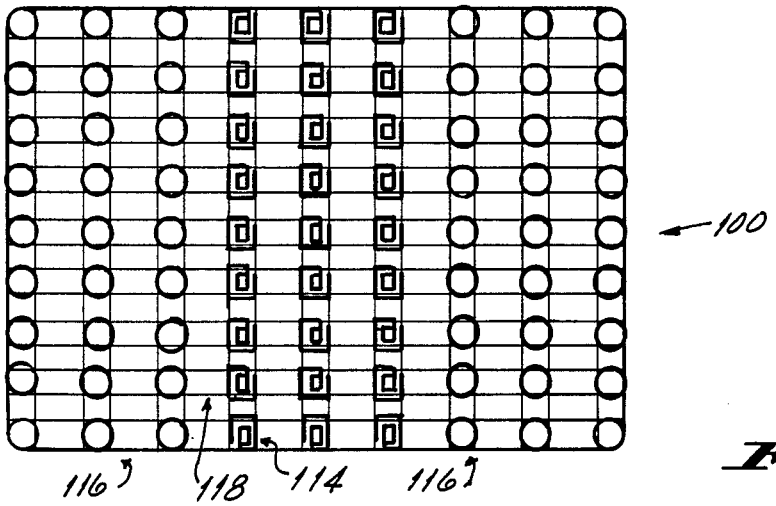
FIG. 8 is a top plan view of a second modification of a box spring incorporating the invention of this application.

With reference to FIG. 8 there is illustrated another box spring assembly 100 which advantageously incorporates both rectangular torsion bar coil springs and round compression coils. As in the box spring assembly of FIGS. 1–6, the spring coils are all arranged in longitudinal columns and transverse rows. The tops or heads of all of the coil springs are connected as in the embodiment of FIGS. 1–6 to a welded wire grid 118 and the bottom loops are connected to a wooden frame (not shown). This spring assembly 100 incorporates round compression coil springs 116 identical to the round compression coil springs of the modification of FIGS. 1–6 and rectangular torsion bar coil springs 114 identical to the torsion bar coil springs 14 of the embodiment of FIGS. 1–6. In this embodiment, though, the rectangular torsion bar coil springs comprise the three middle transverse rows of the spring assembly while all of the other transverse rows of coil springs comprise round compression coil springs 116. In all other regards the box spring of this assembly is identical to FIGS. 1–6.

The advantage of this FIG. 8 embodiment is that it advantageously locates the more firm torsion bar springs in the longitudinal centermost section of the spring assembly so as to obtain greater firmness at a point wherein most of the load of a person sleeping on the top surface of the assembly is applied. And this FIG. 8 embodiment advantageously combines the resistance to lateral deflection to the top surface of the spring assembly characteristic of torsion bar coil springs with the resiliency of the round coil springs. Since the top loop or heads of all of the coil springs, including the torsion bar coil springs 114 and the circular compression coil springs 116 are all fixedly interconnected by the welded wire grid 118, the resistance to lateral deflection of the torsion bar coils 114 is transmitted through the grid 118 to the less lateral deflection resistant round coils. Thus, the complete top surface of the spring assembly 100 is resistant to lateral movement with the result that movement or motion of one of two people sleeping on the spring assembly is not transmitted through the spring unit from one person to the other.

While I have described only two preferred embodiments of my invention, persons skilled in this art will appreciate numerous changes and modifications which may be made without departing from the spirit of my invention. Therefore, I do not intend to be limited except by the scope of the following appended claims.

I claim:

1. A bedding spring assembly comprising, a rectangular border frame having elongated side and end border members, a first series of laterally spaced parallel grid wires extending between the end border members, a second series of laterally spaced parallel grid wires extending between the side border members and crossing the first series of wires at right angles thereto, the two series of wires being fixedly connected at their ends to the border members and to each other at their crossing point to define a substantially planar grid of lateral and longitudinal rows of adjacent rectangular openings, a plurality of reversely U-shaped bends formed in at least one of said series of grid wires medially of said crossing points of said series of wires, each of said U-shaped bends being formed into a downwardly open hook, a first series of resilient wire spring components, each of said components of said first series comprising a head section located in a horizontal plane and a vertically extensive spring body section depending from said head section, a second series of resilient wire spring components, each of said components of said second series comprising a head section located in a horizontal plane and a vertically extensive spring body section depending from said head section, each of said head sections of said spring components of both said first and second series being fixedly mounted within at least two of said downwardly open hooks of grid wires so as to secure said spring components to said wire grid, each of said spring body sections of said first and second series of spring components being generally coil shaped and terminating at their lower ends in bottom attachment sections, means for securing said bottom attachment sections of each of said first and second series of spring components to a base, said generally coil shaped body sections of said first series of spring components being round so as to form circular compression coil springs, said generally coil shaped body sections of said second series of spring components being generally rectangular and defined by a succession of straight lengths of wire bent at right angles to the adjacent straight lengths to form rectangular torsion coil springs, said first and second series of compression and torsion coil spring components cooperating to form a compressible spring assembly having substantial resistance to side-sway of the top surface of said spring assembly, said spring components being arranged in lateral and longitudinal spring rows, and all of said rectangular torsion coil spring components being located at the end of either a lateral or a longitudinal spring row.

2. The bedding spring assembly of claim 1 wherein all of the spring components in said lateral and longitudinal rows, other than said spring components which are located at the ends of said lateral and longitudinal spring rows, are circular compression coil springs.

3. The bedding spring assembly of claim 2 wherein the corner spring components of said spring assembly are circular compression coil springs.

4. A bedding spring assembly comprising, a rectangular wire grid formed of a rectangular border wire and two series of parallel grid wires extending between the border wire, said two series of wires being located in a common top plane of said spring assembly and intersecting one another, said grid wires being welded together at their intersections, the wires of at least one of said series being formed with a plurality of return bends each providing a downwardly open channel, and said return bends being arranged in pairs, a first and second series of coil springs, each of said coil springs of both said first and second series of coil springs having a top convolution received in the channels provided by a pair of said return bends being bent over to fixedly secure said top convolutions of said coils in said channels, each of said coil springs having a coil shaped body section, the coil shaped body section of said first series being generally round so as to form compression coil springs and the coil shaped body section of said second series being generally rectangular and formed by a succession of straight lengths of wire bent at right angles to the adjacent straight lengths to form rectangular torsion coil springs, said first and second series of compression and torsion coil springs cooperating to form a compressible spring assembly having substantial resistance to side-sway of the wire grid top surface of said spring assembly, said coil springs being arranged in lateral and longitudinal spring rows, and all of said rectangular torsion coil springs being located at the end of either a lateral or a longitudinal spring row.

5. The bedding spring assembly of claim 4 wherein all of the spring components in said lateral and longitudinal rows, other than said spring components which are located at the ends of said lateral and longitudinal spring rows, are circular compression coil springs.

6. The bedding spring assembly of claim 5 wherein the corner spring components of said spring assembly are circular compression coil springs.

7. A bedding spring assembly comprising, a rectangular wire grid formed of a rectangular border wire and two series of parallel grid wires extending between the border wire, said two series of wires being located in a common top plane of said spring assembly and intersecting one another, a first and second series of coil springs, each of said coil springs of both said first and second series of coil springs having a top convolution connected to said wire grid, each of said coil springs having a coil shaped body section, the coil shaped body section of said first series being generally round so as to form compression coil springs and the coil shaped body section of said second series being generally rectangular and formed by a succession of straight lengths of wire bent at right angles to the adjacent straight lengths to form rectangular torsion bar coil springs, said first and second series of compression and torsion bar coil spring cooperating to form a compressible spring assembly having substantial resistance to side-sway of the wire grid top surface of said spring assembly, said coil springs being arranged in lateral and longitudinal spring rows, and all of said rectangular torsion bar coil springs being located at the end of either a lateral or a longitudinal spring.

8. The bedding spring assembly of claim 7 wherein all of the spring components in said lateral and longitudinal rows, other than said spring components which are located at the ends of said lateral and longitudinal spring rows, are circular compression coil springs.

9. The bedding spring assembly of claim 8 wherein the corner spring components of said spring assembly are circular compression coil springs.

* * * * *